United States Patent [19]

Brooks

[11] 4,192,654

[45] Mar. 11, 1980

[54] COAL GASIFICATION PLANT

[75] Inventor: Charles T. Brooks, Kinross, Scotland

[73] Assignee: British Gas Corporation, London, England

[21] Appl. No.: 951,459

[22] Filed: Oct. 16, 1978

[30] Foreign Application Priority Data

Sep. 8, 1978 [GB] United Kingdom ..... 36126/78

[51] Int. Cl.[2] ..... B01J 3/00

[52] U.S. Cl. ..... 48/62 R; 48/73; 48/87; 48/202; 48/DIG. 2; 222/591; 266/236; 432/96

[58] Field of Search ..... 48/77, 76, 62 R, 92, 48/63, DIG. 2; 110/165 R; 122/235 N; 164/337, 335; 266/236, 271, 195, 196, 167; 222/591, 592; 75/46

[56] References Cited

U.S. PATENT DOCUMENTS 2,961,722 11/1960 Lilljekirst et al. ..... 222/591

3,429,972 2/1969 DeBussy ..... 222/592

FOREIGN PATENT DOCUMENTS 266180 9/1964 Australia ..... 48/76

*Primary Examiner*—S. Leon Bashore
*Assistant Examiner*—George C. Yeung
*Attorney, Agent, or Firm*—Larson, Taylor and Hinds

[57] ABSTRACT

A removable annular hearth member, shaped to fit over the slag outlet member of a slagging gasifier, comprises a cast body of high thermal conductivity having integral liquid coolant passageways, the central openings of the annular hearth member and slag outlet member being arranged in vertical alignment for the discharge of slag, and the lower portion of the hearth member opening having a lip or beak extending downwardly so as to form a sealed joint with the slag outlet opening whereby in operation of the gasifier to prevent preparation of molten slag therebetween.

4 Claims, 2 Drawing Figures

COAL GASIFICATION PLANT

Figure 1:
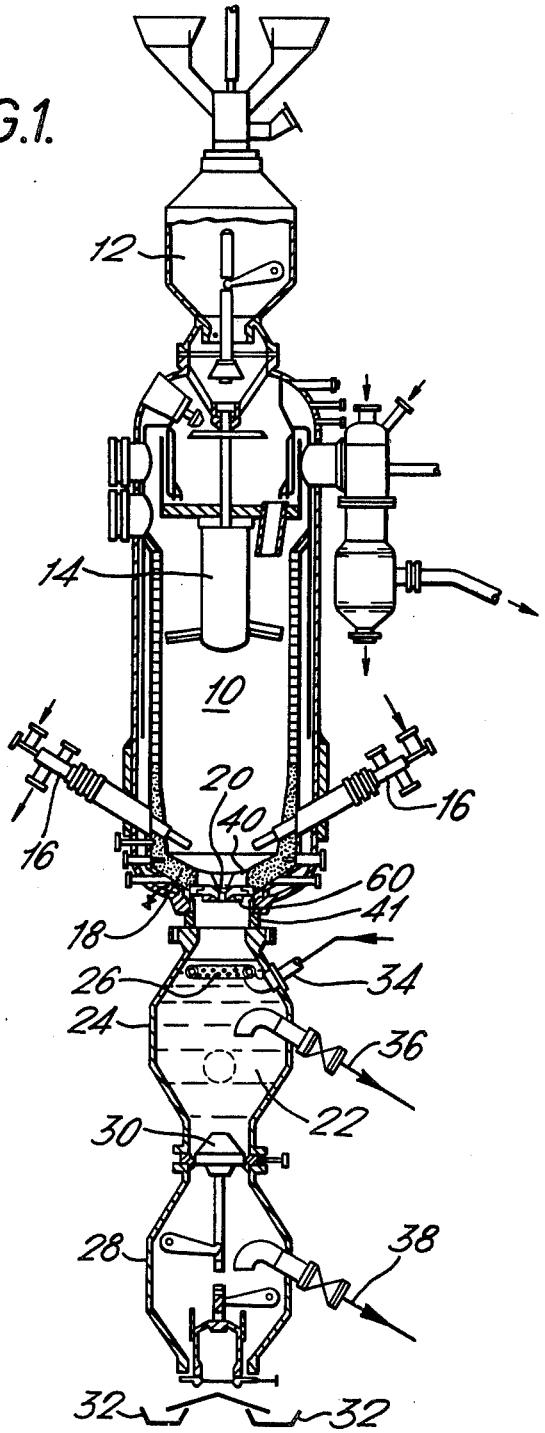

This invention relates to coal gasification plant, and more particularly to coal slagging gasifier plants of the kind in which coal, or other carbonaceous fuel, is introduced into the top of a column-like gasifying vessel and is gasified under high pressure and temperature by means of a gas, for example oxygen and steam, introduced into the fuel bed through tuyeres. The residual ash collects as a molten slag and iron in the hearth of the gasifier vessel from which it is periodically discharged (commonly known as slag-tapping) downwardly through a slag tap outlet or orifice in the hearth into water contained in a quenching chamber vessel. Usually, a pool of molten slag and iron is maintained in the hearth by directing hot combustion products from a burner located beneath the slag tap orifice up the tap orifice to retain the pool of slag and iron in the hearth, the tapping of the molten slag and iron being initiated and controlled by stopping or reducing the burner output and reducing the pressure in the quenching chamber by controlled venting through its venting system so as to produce a differential pressure between the quenching chamber and the gasifier vessel.

The Government of the United States of America has rights in this invention pursuant to the subcontract dated June 2, 1977 and made between British Gas Corporation and Continental Oil Company under Prime Contract No. E(49-18)-2012 awarded by the U.S. Energy Research and Development Administration.

Examples of such slagging gasifier plant are those disclosed in United Kingdom patent specification No. 977,122 and The Gas Council Research Communication No's GC 50 and GC 112.

During the operation of such gasifiers, the slag tap and hearth are subject to aggressive erosion, corrosion and thermal attack by the molten slag and iron. High temperature and mobility of the slag and iron during slag-tapping and slag-retention operations make the containment materials of the slag-tap and its immediate hearth areas primarily subject to erosion and thermal attack.

Our co-pending U.S.A. patent application Ser. No. 771,330, now U.S. Pat. No. 4,129,422, describes a slagging gasifier in which the slag removal orifice is located centrally within the gasifier hearth which includes a removable annular hearth member located so as to fit over and around the slag tap orifice and comprising a slid mass of high thermal conductivity material having an integral passageway for circulating a coolant liquid through said mass and an inlet and outlet communicating said passageway exteriorly of the mass.

An object of the present invention is to provide an improved hearth arrangement for a slagging gasifier.

According to the present invention, in a slagging gasifier comprising: a gasifying vessel; means for introducing coal into said vessel for gasification thereof in said vessel; means for introducing oxygen and steam into said vessel to effect gasification of coal therein; and a hearth located at the bottom of said vessel and including a liquid cooled slag tap member having a slag removal orifice located centrally within said hearth for removing slag from the vessel; wherein said hearth further includes a removable liquid cooled annular hearth member located aboet said slag tap member with the openings of said slag tap member and said annular hearth member in vertical alignment for discharge of slag therethrough. Preferably, the annular hearth member sits on top of the slag tap member so as to form a joint between their mutually contacting surfaces, and the hearth member may be formed with a downwardly extending part at the lower region of its said opening for providing a seal over said joint to prevent the ingress of molten slag therebetween.

Conveniently, said downwardly extending part may be in the form of an annular beak-shaped or lip-shaped extension whose outer peripheral surface conforms to the inner peripheral surface of said slag tap opening so as to be in sealing contact therewith.

The resistance to erosion of the annular hearth member and the slag-tap member depends on critical factors of design, involving, among other things, the thermal conductivity of the material used, the shape and geometry of its metal mass, the size and shape of the orifice, and the size, length and location of the coolant passageways with respect to the surfaces exposed to thermal attack.

The amount and rate of flow of coolant liquid is also an important factor in the design of the annular hearth member and slag tap member since the exposed surfaces must be cooled efficiently to maintain acceptable surface temperatures, but on the other hand it is important that excessive quantities of heat are not removed from the hearth. Typically, coolant liquid flow velocities of the order of 20–30 ft/sec are preferred to give a constant passageway wall temperature.

Preferably, the slag tap and annular hearth members are formed of copper or copper and alloyed metal.

Preferably also, the coolant passageways are of spiral form, the convolutions thereof extending at least around and near to the exposed surfaces of the annular hearth member and slag tap member.

Conveniently, the coolant passageways may be provided by a metal tube of spirally coiled form, the ends of which project exteriorly of the surrounding metal mass to provide an inlet and outlet.

Preferably, the uppermost annular surface of the hearth member is dished shape and its inner peripheral wall is formed in a surface revolution whose profile defines either a divergent or convergent funnel merging with the internal profile of the slag tap opening.

Normally, the hearth area surrounding the annular hearth member slopes downwardly and will be provided by a bed of refractory material having liquid-cooled conduits embedded therein. However, where, for example, the sloping hearth is lined or additionally formed from a number of partially overlapping annular layers of refractory bricks, the annular hearth member may be surmounted by the lowermost annular layer of said bricks which can conveniently be cooled by mutual contact with the liquid-cooled hearth member which supports them.

Figure 2:
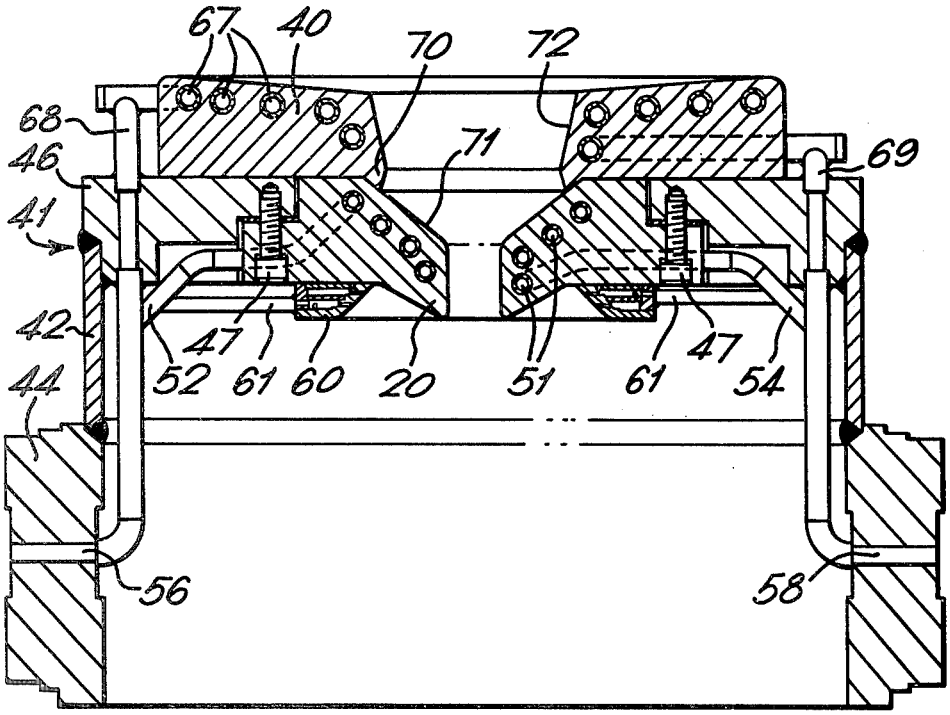

The invention will now be described, by way of example, with reference to the accompanying diagrammatic drawings, in which:

FIG. 1 is a general longitudinal sectional elevation of a fixed-bed slagging gasifier incorporating a hearth arrangement in accordance with the invention, and FIG. 2 is enlarged longitudinal sectional elevation of an annular hearth arrangement shown in FIG. 1.

Referring first to FIG. 1, the gasifier has a refractory-lined pressurized gasification chamber 10 into which coal is fed from a lock hopper 12 and distributed by rotatable distributor means 14. Oxygen and steam are introduced into the fuel bed (not shown) through tuyeres 16 to promote gasification of the coal. In use of the gasifier, a reservoir of molten slag collects on the sloping hearth 18 and is periodically passed, via a slag outlet or tap 20, into a water reservoir 22 contained in a quenching chamber 24 where it is rapidly quenched in a region of turbulent water issuing from a perforated tubular ring 26 before being transferred to a lock hooper 28, upon operation of a valve 30, in the form of a dense small-grained frit entrained with some of the quenching water. The frit is discharged from the lock hopper 28 onto moving conveyors 32. Water supplied to the quench ring 26 through an inlet 34 may partly be water recirculated through outlets 36, 38 from the quenching chamber and slag lock hopper 24, 28 respectively by pump and filter means (not shown). The region of the hearth surrounding the slag tap 20 is provided with an annular hearth member 40.

Referring also to FIG. 2, the quenching chamber 24 is secured in a gas-tight manner to the bottom of the gasifier chamber 10 through the intermediary of a removable sandwich flange assembly 41 which consists of a cylindrical steel sleeve 42 having a thick steel flange member 44 welded to its lower end and a steel annular block 46 welded to its upper end. The slag tap 20 is supported by the block 46 by means of bolts 47. Coolant water is fed to coiled waterways 51 formed in the slag tap 20 through inlet and outlet pipes 52, 54 whose external connections 56, 58 pass through the flange 44. The annular hearth member 40 is supported on top of the slag tap member 20 and annular block 46. Coolant water is also fed to coiled waterways 67 formed in the cast body of hearth member 40 through inlet and outlet pipes 68, 69 whose external connections also pass through the flange 44. A nozzle-mix ring burner 60 is secured co-axially beneath the slag tap member 20 about its central orifice and the air and/or oxygen and gas supply pipes 61 thereto have terminal connections (not shown) in the flange 44.

Preferably, the assembly 41 is secured in position in a gas tight manner by means of bolts (not shown) which draw up the flange of the quenching chamber towards the flange at the base of the gasifier chamber so as to clamp the flange 44 of the assembly therebetween (See FIG. 1). With this arrangement, the burner 60, the slag tap 20 and annular hearth member can be readily removed for servicing by unbolting and lowering the quenching chamber from the gasifier vessel, and withdrawing the sandwich flange assembly 41.

The mutual contact between the undersurface of the hearth member 40 and the upper surface of the slag tap member 20 defines a joint 66 therebetween, and in order to prevent the damage caused by seepage of molten slag through the joint, the hearth member 40 is formed with a downwardly extending annular beak 70 whose outer peripheral surface corresponds to the sloping surface 71 of the slag tap opening with which it is in mutual contact. This arrangement effectively provides a seal for said joint interfaces.

Although in the preferred embodiment shown, the surface of revolution of the hearth member opening 72 is of downwardly converging profile, in some cases it may be of downwardly diverging profile which will more effectively protect the slag tap member from turbulence developed in the gasifier raceway and potential slag iron washing, besides assisting to break up bubble formation and pulsing from burner/slagpool interaction.

I claim:

1. A coal slagging gasifier comprising: a gasifying vessel; means for introducing coal into said vessel for gasification thereof in said vessel; means for introducing oxygen and steam into said vessel to effect gasification of coal therein; and a hearth located at the bottom of said vessel and including a liquid cooled slag tap member having a slag removal orifice located centrally within said hearth for removing slag from the vessel; wherein said hearth further includes a removable liquid cooled annular hearth member and in contact with said slag tap member located above said slag tap member with the opening in said annular hearth member being vertically aligned with said orifice for discharge of slag therethrough.

2. A coal slagging gasifier according to claim 1, wherein the annular hearth member sits on top of the slag tap member so as to form a joint between their mutually contacting surfaces, and wherein the hearth member is formed with a downwardly extending part at the lower region of its said opening for providing a seal over said joint to prevent the ingress of molten slag therebetween.

3. A coal slagging gasifier according to claim 2, wherein said downwardly extending part is in the form of an annular beak-shaped or lip-shaped extension whose outer peripheral surface conforms to an inner peripheral surface of said slag tap orifice so as to be in sealing contact therewith.

4. A coal slagging gasifier according to claim 1 further comprising means for directing hot combustion products up the tap orifice to retain a pool of slag and iron in the hearth.

* * * * *